US008616910B2

(12) United States Patent
Giefers et al.

(10) Patent No.: US 8,616,910 B2
(45) Date of Patent: Dec. 31, 2013

(54) FASTENING DEVICE FOR FASTENING A CONNECTOR PLUG TO A BASE HOUSING

(75) Inventors: Stefan Giefers, Detmold (DE); Udo Hoppe, Blomberg (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 0 days.

(21) Appl. No.: 13/266,456

(22) PCT Filed: Apr. 27, 2010

(86) PCT No.: PCT/EP2010/002572

§ 371 (c)(1),
(2), (4) Date: Oct. 26, 2011

(87) PCT Pub. No.: WO2010/124842

PCT Pub. Date: Nov. 4, 2010

(65) Prior Publication Data

US 2012/0045922 A1 Feb. 23, 2012

(30) Foreign Application Priority Data

Apr. 27, 2009 (DE) ..... 10 2009 018 715

(51) Int. Cl.
*H01R 13/627* (2006.01)

(52) U.S. Cl.
USPC ..... 439/358; 439/372

(58) Field of Classification Search
USPC ..... 439/153–160, 357–358, 372
See application file for complete search history.

(56) References Cited

U.S. PATENT DOCUMENTS

| | | | | |
|---|---|---|---|---|
| 6,350,159 | B1 * | 2/2002 | Wu | 439/680 |
| 6,394,824 | B1 * | 5/2002 | Huang | 439/108 |
| 6,592,392 | B2 * | 7/2003 | Po-Heng | 439/358 |
| 7,128,595 | B2 * | 10/2006 | Boutros | 439/358 |
| 7,438,569 | B2 * | 10/2008 | Pennypacker et al. | 439/157 |
| 7,534,125 | B1 * | 5/2009 | Schroll | 439/352 |
| 7,892,007 | B2 * | 2/2011 | Scherer et al. | 439/329 |
| 8,258,556 | B2 * | 9/2012 | Lee et al. | 257/291 |

FOREIGN PATENT DOCUMENTS

| | | |
|---|---|---|
| DE | 8813990 | 2/1989 |
| WO | 0055710 A1 | 9/2000 |

* cited by examiner

*Primary Examiner* — Thanh Tam Le
(74) *Attorney, Agent, or Firm* — TechLaw LLP; Jonathan A. Kidney

(57) ABSTRACT

A fastening device is described that is arranged on a plug assembly having a connector plug and a base housing, having a fastening element for fastening the connector plug to the base housing, the connector plug having a plug housing with a screw shaft. The fastening element has a first fastening region and a second fastening region, wherein the first fastening region of the fastening element can be fixed to the screw shaft of the plug housing, and the second fastening region of the fastening element can be fixed to an outer surface of the base housing.

10 Claims, 5 Drawing Sheets

FASTENING DEVICE FOR FASTENING A CONNECTOR PLUG TO A BASE HOUSING

CROSS-REFERENCE TO RELATED APPLICATIONS

This application is a national stage filing of PCT Application No. PCT/EP2010/002572 filed 27 Apr. 2010 claiming priority to German Patent Application No. 102009018715.4 (DE), titled "FASTENING DEVICE FOR FASTENING A CONNECTOR PLUG TO A BASE HOUSING," filed 27 Apr. 2009, the contents of which are hereby incorporated by reference in its entirety.

FIELD

The invention relates to a fastening device for fastening a connector plug to a base housing by means of a fastening element. The invention also relates to a plug arrangement with such a fastening device.

BACKGROUND

A connector plug normally has a plug housing, which is composed of an insulating material and has at least one conductor connecting element arranged therein, and a plug contact which is connected to the conductor connecting element. The connector plug may in this case be in the form of a screw connecting terminal, on the plug housing of which a screw shaft is provided, via which a screw can be inserted into the interior of the plug housing. A base housing can be provided for fastening a connector plug such as this to a printed circuit board, which base housing is normally arranged via solder pins on the printed circuit board and has a plug location for plugging on the connector plug. Plug arrangements such as these are used primarily where direct-contact protection for the connector plug is desired on the printed circuit board.

In order to make a safe connection between the connector plug and the base housing, it is known for fastening devices to be provided which have a fastening means. Specific holding elements, for example in the form of openings, are generally provided for the fastening means on the connector plug and/or on the base housing, in which openings the fastening means engage in the fastened state, that is to say in the state when the connector plug is fastened to the base housing. On the one hand, this increases the design complexity of such plug arrangements and, furthermore, the fastening elements are in this case generally arranged on the connector plug and the base housing such that a user can access them only with difficulty, and their operation is therefore difficult. This makes it considerably more difficult to replace the fastening elements, which can generally be done only by means of additional tools. Since additional holding elements are required for fastening the fastening element, retrofitting of a plug arrangement with such fastening elements is generally impossible. Furthermore, such fastening means generally require a larger additional physical space, as a result of which the overall physical space required for the plug arrangement together with the fastening element can lead to major problems, in particular for installation in switchgear cabinets.

Consequently, there has been a long standing need for a fastening device for a plug which has a connector plug and a base housing, the plug arrangement being distinguished by a simple design, and which can be operated easily and replaced or retrofitted to existing plug arrangements at any time. These and other needs are addressed by various systems and methods as elucidated in the following description.

SUMMARY

The following presents a simplified summary in order to provide a basic understanding of some aspects of the claimed subject matter. This summary is not an extensive overview, and is not intended to identify key/critical elements or to delineate the scope of the claimed subject matter. Its purpose is to present some concepts in a simplified form as a prelude to the more detailed description that is presented later.

In another aspect of the present disclosure, a fastening device for fastening a connector plug to a base housing, the connector plug having a plug housing with a screw shaft, is provided, comprising: a fastening element having a first fastening area and a second fastening area, wherein the first fastening area can be fastened to the screw shaft of the plug housing, and the second fastening area can be fastened to an outer surface of the base housing.

In another aspect of the present disclosure, a plug arrangement, is provided, comprising: a connector plug having a plug housing with a screw shaft; a base housing compatible for mating to the connector plug; and a fastening device, comprising: a fastening element having a first fastening area and a second fastening area, wherein the first fastening area can be fastened to the screw shaft of the plug housing, and the second fastening area can be fastened to an outer surface of the base housing.

To the accomplishment of the foregoing and related ends, certain illustrative aspects are described herein in connection with the following description and the annexed drawings. These aspects are indicative, however, of but a few of the various ways in which the principles of the claimed subject matter may be employed and the claimed subject matter is intended to include all such aspects and their equivalents. Other advantages and novel features may become apparent from the following detailed description when considered in conjunction with the drawings. As such, other aspects of the disclosure are found throughout the specification.

DETAILED DESCRIPTION

Figure 1:
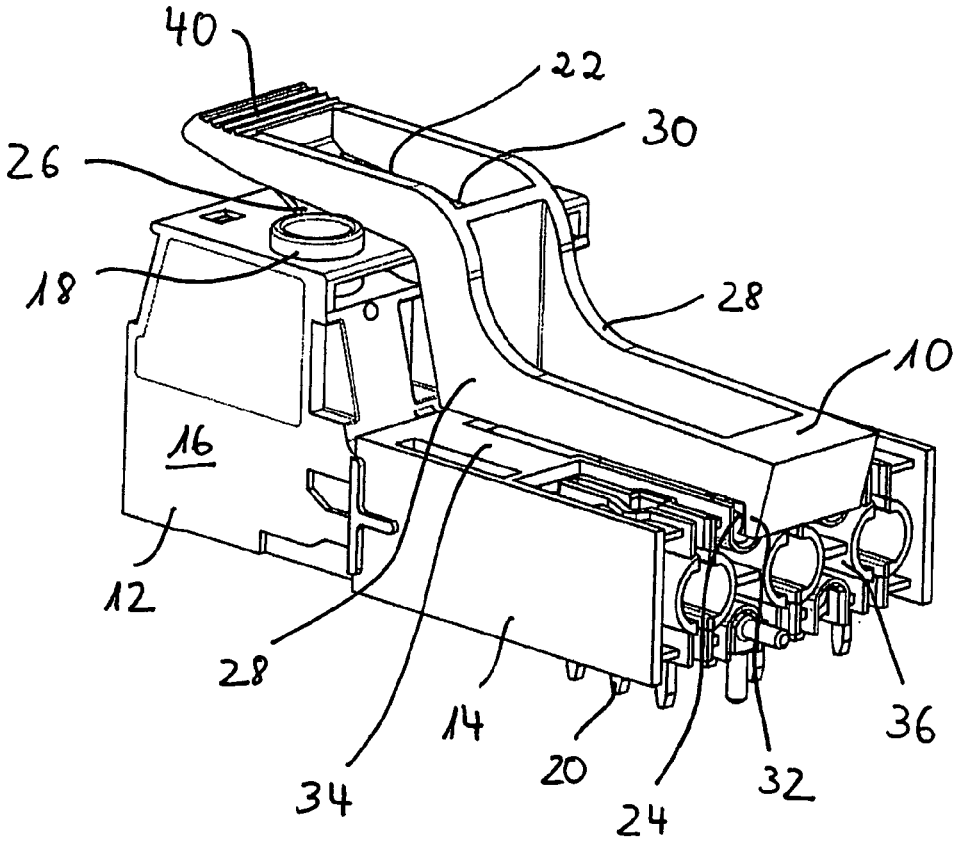
FIG. 1 shows a perspective schematic illustration of an exemplary fastening device, in the fastened state, according to a first embodiment.

Various exemplary embodiments describe a fastening device for arrangement on a plug arrangement which has a connector plug and a base housing, whose plug arrangement is distinguished by a simple design configuration, which also can be operated easily and be replaced or retrofitted to existing plug arrangements at any time.

The exemplary device is for arrangement on a plug arrangement which has a connector plug and a base housing which has a fastening element for fastening the connector plug to the base housing, with the connector plug having a plug housing with a screw shaft. The fastening element has a first fastening area and a second fastening area, in which case the first fastening area of the fastening element can be fastened to the screw shaft of the plug housing, and the second fastening area of the fastening element can be fastened to an outer surface of the base housing.

The exemplary fastening device makes it possible to prevent inadvertent disconnection of the connector plug from the base housing. The exemplary fastening device is also distinguished in that, in comparison to the known fastening devices, no additional holding elements are any longer required in this case in order to fasten a fastening element to the connector plug and to the base housing, since only elements which are already present on the plug arrangement are used for fastening, in that the fastening element is on the one hand fastened to the shaft opening which is present on the connector plug, and on the other hand is fastened to an outer surface of the base housing, without having to provide additional holding elements on the outer surface of the base housing. Since only elements, which are already present on the plug arrangement, are used for fastening, the exemplary fastening device as shown below can be retrofitted at any time to already existing plug arrangements. There is no need for complex structures for such fastening devices for fastening a connector plug to a base housing, thus saving costs and time. Furthermore, the saving of additional holding elements for the exemplary fastening element makes it possible to considerably reduce the physical space required for an exemplary fastening device.

In order to fasten the first fastening area to the screw shaft of the plug housing, the first fastening area desirably has a hook element. In a fastened state of the fastening element, the hook element is arranged at an angle of <90° with respect to the surface of the fastening element. In the fastened state, the fastening element is fastened to the connector plug and to the base housing. In this case, the hook element is latched to the outer surface or to an outer edge of the screw shaft, such that the hook element hooks onto the outer surface of the screw shaft and is thus held or fixed on the screw shaft. In the hooked-in state, the hook element is spread out by the fastening element, such that the hook element is arranged at an angle of <90°, desirably at an angle of between 10° and 45°, with respect to the surface of the fastening element, in particular with respect to the surface of the fastening element which faces the plug housing.

In the unfastened state of the fastening element, that is to say when the fastening element has not been fastened to the plug arrangement, the hook element is desirably in the form of a wall surface of the fastening element and, in the fastened state, the hook element desirably releases an opening on the fastening element. In order to fasten the hook element to the screw shaft, the hook element, which is in the form of a wall surface in the unfastened state, can be bent downward, thus creating an opening on the fastening element. In the fastened state of the fastening element, the screw shaft is inserted into this opening, such that the screw shaft is clamped firmly between the hook element and the side surfaces of the fastening element, which side surfaces are in the form of webs. Therefore, the hook element is desirably not a separate component which has to be fitted additionally to the fastening element, it is a part of the fastening element. This makes it possible to reduce both material and the manufacturing outlay for a fastening element such as this. Furthermore, because the screw shaft is clamped into the opening which is released by the hook element, the fastening element can be clamped to the connector plug such that it is particularly resistant to sliding.

According to a further refinement of the exemplary device, the fastening element is in the form of a film hinge and the fastening element is borne on its first fastening area such that it can pivot on the screw shaft. Since the fastening element is in the form of a film hinge, it has a fairly flat shape, in the form of a plate, such that the fastening element requires only a small physical space and can therefore be used while saving as much space as possible. In this case, the fastening element is desirably formed from a plastic material, as a result of which the fastening element is electrically insulating and can therefore be used for direct-contact protection. Furthermore, the fastening element is desirably designed to be sprung, with the hook element desirably being in the form of a spring element, such that the fastening element is borne on its first fastening area such that it can pivot on the screw shaft. This allows the operating element to be handled particularly easily by an operator.

Provision is furthermore made for the capability to fasten the first fastening area to the screw shaft by means of an adhesive joint. In this case, the hook element is desirably fastened to the screw shaft by means of the adhesive joint, such that the fastening element can be fixed particularly securely in a fixed position on its first fastening area, both by hooking into the screw shaft and by an adhesive joint, thus making it possible to prevent the fastening element from sliding, even when major loads are applied.

According to a further advantageous refinement of the exemplary device, in the fastened state of the fastening element, the fastening element is arranged such that the fastening element covers a first side surface of the base housing from the first fastening area to the second fastening area, in which case, in the fastened state of the fastening element, the second fastening area rests on a second side surface, which is arranged transversely with respect to the first side surface, of the base housing. The base housing is therefore clamped in by the fastening element, and is pressed against the plug housing of the connector plug. It is therefore possible to firmly connect the connector plug to the base housing without additional connecting elements being required on the base housing. Furthermore, the fastening itself can be implemented easily, since the fastening element, which is first of all fastened to the first fastening area, can be pushed over the first side surface of the base housing until the part of the fastening element on which the second fastening area is provided comes to rest on the second side surface, which is arranged transversely with respect to the first side surface, and therefore engages behind the second side surface of the base housing. The fastening element or the fastening device can therefore be handled particularly easily, without any need for additional tools.

In order to engage behind the second side surface of the base housing, the second fastening area desirably has a latching tab. The latching tab allows the connector plug to be pressed against the base housing in a simple manner. The base housing is thus clamped in between the latching tab and the connector plug.

Furthermore, according to a further advantageous refinement of the exemplary device, the fastening element has a bearing element which can be inserted into a corresponding bearing recess which is provided on the plug housing. The bearing element allows the fastening element, when it is in its fastened state, to be fastened to the connector plug in addition to its first fastening area.

According to a further advantageous refinement of the exemplary device, the fastening element has a grip section, which is provided in the area of the first fastening area. Since the grip is provided on the first fastening area, the process of releasing the fastening element from the base housing can be handled particularly easily, particularly if the operating element is designed to be sprung and is borne on its first fastening area such that it can pivot on the screw shaft. This allows the fastening element to be operated simply via the grip section, which is easily accessible from the operator side. The release of the operating element and therefore of the connector plug from the base housing can therefore be carried out in a simple manner by operation of the grip section by one finger. There is therefore no longer any need to use an aid or an additional tool. If the hook element is in the form of a spring element, this ensures that the fastening element always remains in its fastened, locked state when the grip section is not being operated.

Furthermore, the exemplary embodiment(s) relates to a plug arrangement having a connector plug and a base housing, in which case the connector plug can be fastened to the base housing by means of a fastening device designed and developed as above. The exemplary embodiments will be explained in more detail in the following text with reference to the drawing.

List of reference symbols

| | |
|---|---|
| Fastening element | 10 |
| Connector plug | 12 |
| Base housing | 14 |
| Plug housing | 16 |
| Screw shaft | 18 |
| Solder pin | 20 |
| First fastening area | 22 |
| Second fastening area | 24 |
| Hook element | 26 |
| Side surface of the fastening element | 28 |
| Opening | 30 |
| Latching tab | 32 |
| First side surface of the base housing | 34 |
| Second side surface of the base housing | 36 |
| Bearing element | 38 |
| Grip section | 40 |

FIG. 1 schematically shows an exemplary fastening device having a fastening element 10 that is fastened to a connector plug 12 and to a base housing 14 which can be connected to the connector plug 12. The connector plug 12 has a plug housing 16, which is composed of an insulating material and has conductor connecting elements arranged therein, and has plug contacts (not illustrated here) which are connected to the conductor connecting elements. The connector plug 12 is in the form of a screw connecting terminal, in which three screw shafts 18 are provided on the plug housing 16, with two of the three screw shafts 18 being concealed by the fastening element 10 in FIG. 1, because of the perspective shown here. One screw is in each case inserted into the interior of the plug housing 16 via each of the screw shafts 18. The base housing 14 is provided in order to fasten a connector plug 12 such as this to a printed circuit board, which is not illustrated here, which base housing 14 can be fastened to the printed circuit board by means of solder pins 20 and has a plurality of plug locations, which are not illustrated here, for plugging on the connector plug 12.

The fastening element 10 is in the form of a film hinge that is produced from a plastic and has a first fastening area 22 and a second fastening area 24. The fastening element 10 can be fastened to the connector plug 12 by means of the first fastening area 22. The first fastening area 22 of the fastening element 10 has a hook element 26. The hook element 26 is desirably designed to be flat, with the side surfaces 18 of the fastening element 10 being in the form of webs, as a result of which the fastening element 10 is sufficiently robust. In the unfastened state of the fastening element 10, that is to say when the fastening element 10 is not fastened to the plug arrangement, the hook element 26 is desirably in the form of a wall surface of the fastening element 10. In order to fasten the hook element 26 to the screw shaft 18, the hook element 26, which is in the form of a wall surface in the unfastened state, can be bent downward, thus producing an opening 30 on the fastening element 10.

In the fastened state, as is shown in FIG. 1, at least a part of the screw shaft 18 is inserted into this opening 30, in particular that part of the screw shaft 18 which is arranged raised from the outer surface of the plug housing 16, such that the screw shaft 18 is firmly clamped between the hook element 26 and the side surfaces 28 of the fastening element 10, which side surfaces 28 are in the form of webs. In this case, the hook element 26 is in the form of a spring element, such that the fastening element 10 is borne on its first fastening area 22 such that it can pivot on the screw shaft 18. The fastening element 10 may in this case act as a type of rocker. Because the fulcrum of the fastening element 10 is on the first fastening area 22, the fastening element 10 is able to remain in its position, and not to be released therefrom, when a tensile force is applied to the connector plug 12 and/or to the base housing 14.

The second fastening area 24 of the fastening element 10 is provided opposite the first fastening area 22 at the other end of the fastening element 10. The second fastening area 24 has a latching tab 32 which, when the fastening element 10 is in the fastened state, rests on an outer surface of the base housing 14 such that the latching tab 32 engages behind the base housing 14, such that the base housing 14 is clamped firmly between the connector plug 12 and the latching tab 32.

Figure 2:
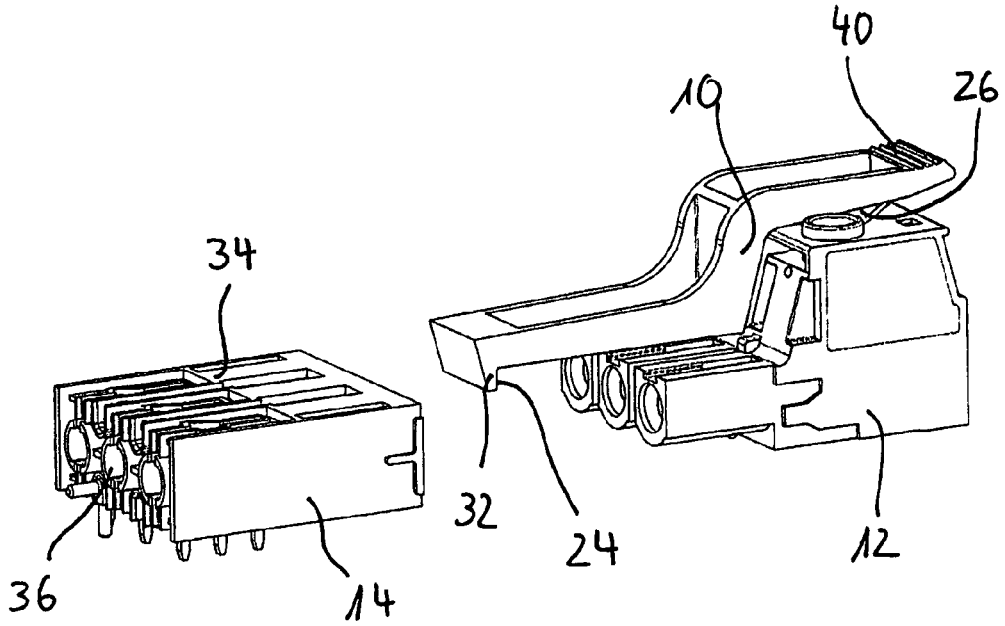
FIG. 2 shows a perspective schematic illustration of the exemplary fastening device shown in FIG. 1, together with a connector plug and a base housing.
Figure 3:
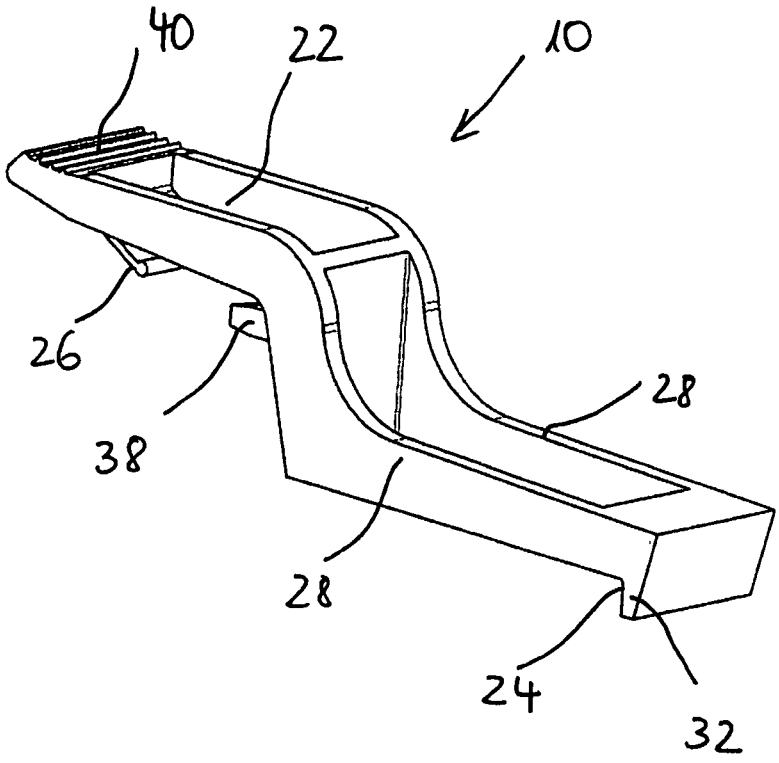
FIG. 3 shows a perspective schematic illustration of the exemplary fastening device shown in FIG. 1, in the unfastened state.

As is shown in FIG. 2, when the fastening element 10 is transferred from the unfastened state to the fastened state, the fastening element 10 is first of all hooked in by the first fastening area on the screw shaft 18 of the connector plug 12. The rest of the fastening element 10 is then pushed desirably over the entire length of a first side surface 34 of the base housing 14, until the latching tab 32 comes to rest on the second side surface 36, which is arranged transversely with respect to the first side surface 34, of the base housing 12, such that the latching tab 16 therefore engages behind the second side surface 34 of the base housing 14.

In order to fasten the fastening element 10 particularly securely to the connector plug 12, in particular such that it cannot slide, the hook element 26 additionally has a bearing element 38 which can be inserted into a corresponding bearing recess (not illustrated here) which is provided on the plug housing 16.

In the area of the first fastening area 22, the fastening element 10 furthermore has a grip section 40. Since the grip section 40 is provided in the area of the first fastening area 22, with the grip section 40 projecting over the edge area of the plug housing 16 of the connector plug 12, the fastening element 10 can easily be operated by hand, therefore allowing the connector plug 12 to be released easily from the base housing 14. This is particularly advantageous when the plug arrangement is arranged, for example, in a switchgear cabinet, such that there is only very little free space between the end face of the plug arrangement and the housing wall of the switchgear cabinet. Since the fastening element 10 can easily be operated by pushing one finger against the grip section 40, no additional tool is required to release the connector plug 12.

The grip section 40 optionally has depressions in the form of grooves as a gripping aid and sliding protection when the grip section 40 is operated.

Figure 4:
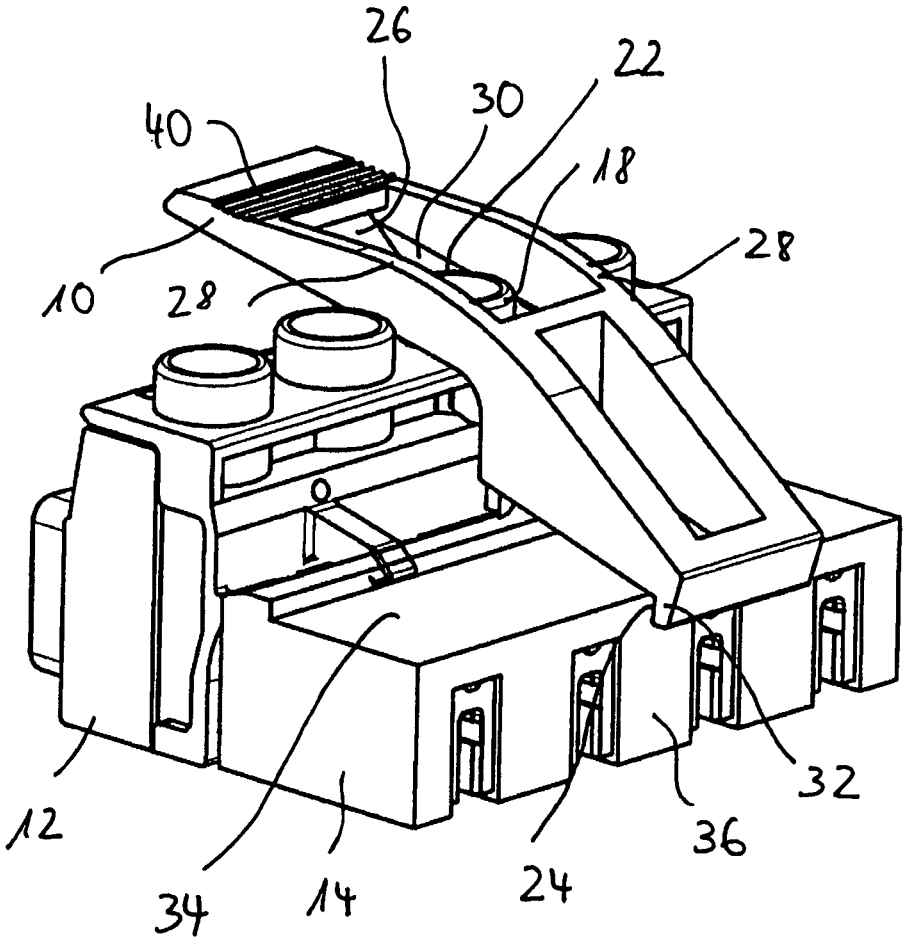
FIG. 4 shows a perspective schematic illustration of an exemplary fastening device, in the fastened state, according to a second embodiment.
Figure 5:
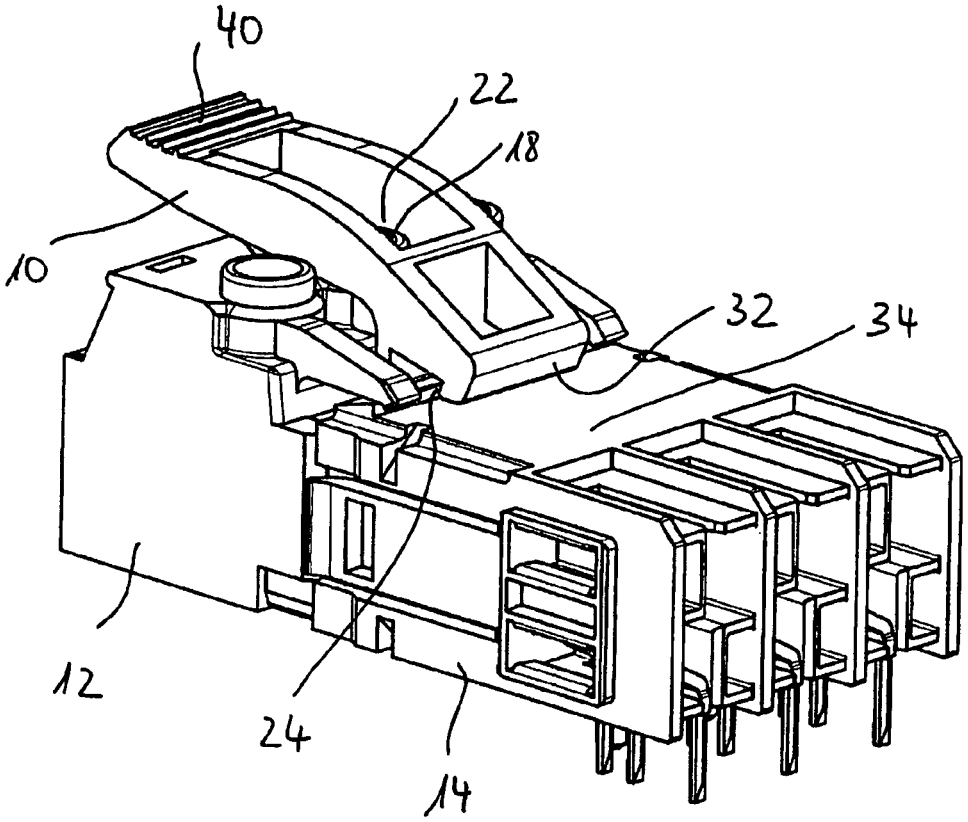
FIG. 5 shows a perspective schematic illustration of an exemplary fastening device, in the fastened state, according to a third embodiment.

FIG. 4 and FIG. 5 show two further possible embodiments of the exemplary fastening device. In particular, for an exemplary fastening element 10, with the fastening elements shown in FIG. 4 and FIG. 5 having a shorter length than the embodiment of a fastening element shown in FIG. 1. In the fastened state, the fastening element 10 in FIG. 5 does not cover the entire length of the first side surface 34 of the base housing 14.

What has been described above includes examples of one or more embodiments. It is, of course, not possible to describe every conceivable combination of components or methodologies for purposes of describing the aforementioned embodiments, but one of ordinary skill in the art may recognize that many further combinations and permutations of various embodiments are possible. Accordingly, the described embodiments are intended to embrace all such alterations, modifications and variations that fall within the spirit and scope of the appended claims.

The invention claimed is:

1. A fastening device for fastening a connector plug to a base housing, the connector plug having a plug housing with a screw shaft, comprising:

a fastening element having a first fastening area and a second fastening area, the first fastening area has a hook element for fastening to the screw shaft of the plug housing, wherein, in an unfastened state, the hook element is in the form of a wall surface of the fastening element and, in a fastened state, the hook element releases an opening on the fastening element, and wherein the second fastening area can be fastened to an outer surface of the base housing.

2. The fastening device as in claim 1, wherein the fastening element is in the form of a film hinge and the fastening element is borne on its first fastening area such that it can pivot on the screw shaft.

3. The fastening device as in claim 1, wherein the first fastening area can be fastened to the screw shaft by means of an adhesive joint.

4. The fastening device as in claim 1, wherein, in a fastened state, the fastening element is arranged to cover a first side surface of the base housing from the first fastening area to the second fastening area, wherein the second fastening area rests on a second side surface, which is arranged transversely with respect to the first side surface, of the base housing.

5. The fastening device as in claim 4, wherein the second fastening area has a latching tab for engaging behind the second side surface of the base housing.

6. The fastening device as in claim 1, wherein the fastening element has a bearing element which can be inserted into a corresponding bearing recess which is provided on the plug housing.

7. The fastening device as in claim 1, wherein the fastening element has a grip section, which is provided proximal to the first fastening area.

8. A plug arrangement, comprising:

a connector plug having a plug housing with a screw shaft;

a base housing compatible for mating to the connector plug; and a fastening device, comprising:

a fastening element having a first fastening area and a second fastening area, wherein the first fastening area has a hook element for fastening to the screw shaft of the plug housing, wherein, in an unfastened state, the hook element is in the form of a wall surface of the fastening element and, in a fastened state, the hook element releases an opening on the fastening element, and the second fastening area can be fastened to an outer surface of the base housing.

9. The fastening device as in claim 8, wherein the fastening element is in the form of a film hinge and the fastening element is borne on its first fastening area such that it can pivot on the screw shaft.

10. The fastening device as in claim 8, wherein the first fastening area can be fastened to the screw shaft by means of an adhesive joint.

* * * * *